US011285531B1

(12) United States Patent
Robbins et al.

(10) Patent No.: US 11,285,531 B1
(45) Date of Patent: Mar. 29, 2022

(54) SHOT SLEEVE FOR DIE CASTING APPARATUS, AND DIE CASTING APPARATUS INCORPORATING SAME

(71) Applicants: Paul H. Robbins, Markham (CA); Steve Johnson, Markham (CA)

(72) Inventors: Paul H. Robbins, Markham (CA); Steve Johnson, Markham (CA)

(73) Assignee: Exco Technologies Limited, Markham (CA)

( * ) Notice: Subject to any disclaimer, the term of this patent is extended or adjusted under 35 U.S.C. 154(b) by 0 days.

(21) Appl. No.: 17/161,865

(22) Filed: Jan. 29, 2021

(51) Int. Cl.
*B22D 17/20* (2006.01)

(52) U.S. Cl.
CPC ..... *B22D 17/2023* (2013.01)

(58) Field of Classification Search
CPC . B22D 17/20; B22D 17/2015; B22D 17/2023
USPC ..... 164/284, 303, 312, 113
See application file for complete search history.

(56) References Cited

U.S. PATENT DOCUMENTS

2006/0213634 A1* 9/2006 Kaba et al. ..... B22D 17/2023 164/312
2007/0074842 A1* 4/2007 Manoff ..... B22D 17/2023 164/113
2007/0187061 A1* 8/2007 Siddle et al. ..... B22D 17/2023 164/312
2017/0113269 A1* 4/2017 Robbins ..... B23K 31/02

* cited by examiner

*Primary Examiner* — Kevin P Kerns

(57) ABSTRACT

A shot sleeve for a die casting apparatus has a piston bore, and includes: an elongate body fabricated of a first material, the body having an axial bore extending therethrough; a first sleeve insert fabricated of a second material, the first sleeve insert being accommodated in the axial bore and defining a first surface of the piston bore; and a second sleeve insert fabricated of a third material, the second sleeve being accommodated in the axial bore and defining a second surface of the piston bore, the third material having a higher ductility than the second material.

20 Claims, 10 Drawing Sheets

SHOT SLEEVE FOR DIE CASTING APPARATUS, AND DIE CASTING APPARATUS INCORPORATING SAME

FIELD

The subject disclosure relates generally to die casting and in particular, to a shot sleeve for a die casting apparatus and a die casting apparatus incorporating the same.

BACKGROUND

In the field of automotive manufacturing, structural components that historically have been fabricated of steel, such as engine cradles, are increasingly being replaced with aluminum alloy castings. Such castings are typically large, convoluted, and relatively thin, and are required to meet the high quality standards of automotive manufacturing. In order to meet these requirements, vacuum-assisted die casting is typically used to produce such castings.

Vacuum-assisted die casting machines comprise a piston, sometimes referred to as a "plunger", which is advanced through a piston bore of a shot sleeve to push a volume of liquid metal into a mold cavity. Vacuum is applied to the piston bore to assist the flow of the liquid metal therethrough. A replaceable wear ring fabricated of hardened tool steel is fitted onto the piston, and makes continuous contact with the inside of the piston bore along the full stroke of the piston for providing a seal for both the vacuum and liquid metal.

For example, FIG. 1 shows a portion of a prior art vacuum-assisted die casting apparatus, which is generally indicated by reference numeral 20. Vacuum-assisted die casting apparatus 20 comprises a piston that is moveable within a piston bore 28 defined within a shot sleeve 30 for pushing a volume of liquid metal (not shown) into a die casting mold cavity (not shown) to form a metal casting. In the example shown, the piston is positioned at its starting position of the stroke, which is rearward of a port 34 through which the volume of liquid metal is introduced into the piston bore 28.

The piston comprises a piston tip 40 mounted on a forward end of a piston stem (not shown). The piston tip 40 has a front face 42 that is configured to contact the volume of liquid metal introduced into the piston bore 28 via port 34. The piston tip 40 has a wear ring 44 disposed on an outer surface thereof.

In operation, at the beginning of a stroke cycle, the piston is positioned at its starting position in the piston bore 28, and a volume of liquid metal is introduced into the piston bore 28 forward of the piston tip 40 via port 34. The piston is then moved forward through the piston bore 28 to push the volume of liquid metal into the mold cavity for forming a casting, and is then moved rearward to its starting position to complete the stroke cycle. During this movement, the wear ring 44 disposed on the piston tip 40 continuously contacts the surface 48 of the piston bore 28, and provides a liquid metal seal for preventing liquid metal from passing between the piston tip 40 and the surface 48 of the piston bore 28. The wear ring 44 also provides a vacuum seal for maintaining vacuum (that is, a low pressure) within the forward volume of the piston bore 28. The cycle is repeated, as desired, to produce multiple metal castings.

As will be understood, repeatedly introducing liquid metal into the piston bore subjects the surface 48 of the piston bore 28 to undesirable thermal cycling. Additionally, the continuous contact between the piston and the piston bore 28 wears the surface 48 of the piston bore over many stroke cycles. Such conditions are detrimental to the service life of the shot sleeve.

Die casting shot sleeves having improved mechanical performance have been described. For example, U.S. Pat. No. 5,195,572 to Linden, Jr. et al. discloses a two-piece shot sleeve for use with a die casting machine including first and second cylindrical sleeve sections that are removably axially secured together. The sleeve sections are each open at both ends and include an interior passage for the flow of molten metal, and the second sleeve section includes a pour hole for receiving molten metal into the interior passage.

U.S. Pat. No. 5,322,111 to Hansma discloses a lined shot sleeve for use in metal die casting. The lined shot sleeve comprises an elongated main body portion including a first continuous inner wall surface defining a receptacle bore axially extending between a first end and a second end of the main body portion. An elongated ceramic liner is adapted for secure placement within the receptacle bore, the liner including a second continuous inner wall surface defining a cylinder bore axially extending between a first end and a second end of the liner and an exterior wall surface adapted for frictional contact with the first continuous inner wall surface. The ceramic liner acts as a physical and thermal insulator to protect the first continuous inner wall surface of the main body portion from contact with the molten metal.

International PCT Application No. PCT/CA2016/051225 to Robbins discloses a shot sleeve for a die casting apparatus. The shot sleeve has a piston bore, and comprises an elongate body having an axial bore, and a sleeve liner formed on a surface of the axial bore. The sleeve liner defines a surface of the piston bore.

It is an object at least to provide a novel shot sleeve for a die casting apparatus and a die casting apparatus incorporating the same.

SUMMARY

Accordingly, in one aspect there is provided a shot sleeve for a die casting apparatus, the shot sleeve having a piston bore, the shot sleeve comprising: an elongate body fabricated of a first material, the body having an axial bore extending therethrough; a first sleeve insert fabricated of a second material, the first sleeve insert being accommodated in the axial bore and defining a first surface of the piston bore; and a second sleeve insert fabricated of a third material, the second sleeve being accommodated in the axial bore and defining a second surface of the piston bore, the third material having a higher ductility than the second material.

The body may be fabricated of AISI 4340 grade steel.

The second material may have at least one of: higher hardness than the first material; higher high-temperature yield strength than the first material; and higher aluminum corrosion resistance than the first material. The first sleeve insert may be fabricated of hot worked DIN 1.2367 grade steel.

The third material may have at least one of: higher hardness than the first material; higher high-temperature yield strength than the first material; and higher aluminum corrosion resistance than the first material. The second sleeve insert may be fabricated of hot worked DIN 1.2344 grade steel or AISI H13 grade steel.

The body may comprise a port through which a volume of liquid metal is introduced into the piston bore, the first sleeve insert having an aperture aligned with the port.

The body may have a first end and a second end, and the axial bore may extend between the first end and the second end. The first sleeve insert may be accommodated in the axial bore adjacent the first end. The second sleeve insert may be accommodated in the axial bore adjacent the second end. The second sleeve insert may comprise an outwardly extending flange. The flange may cover the body at the second end. The flange may have a gating channel defined in an upper portion thereof.

In one embodiment, there is provided a die casting apparatus comprising the above-described shot sleeve.

BRIEF DESCRIPTION OF THE DRAWINGS

Embodiments will now be described more fully with reference to the accompanying drawings in which.

DETAILED DESCRIPTION OF EMBODIMENTS

Figure 1:
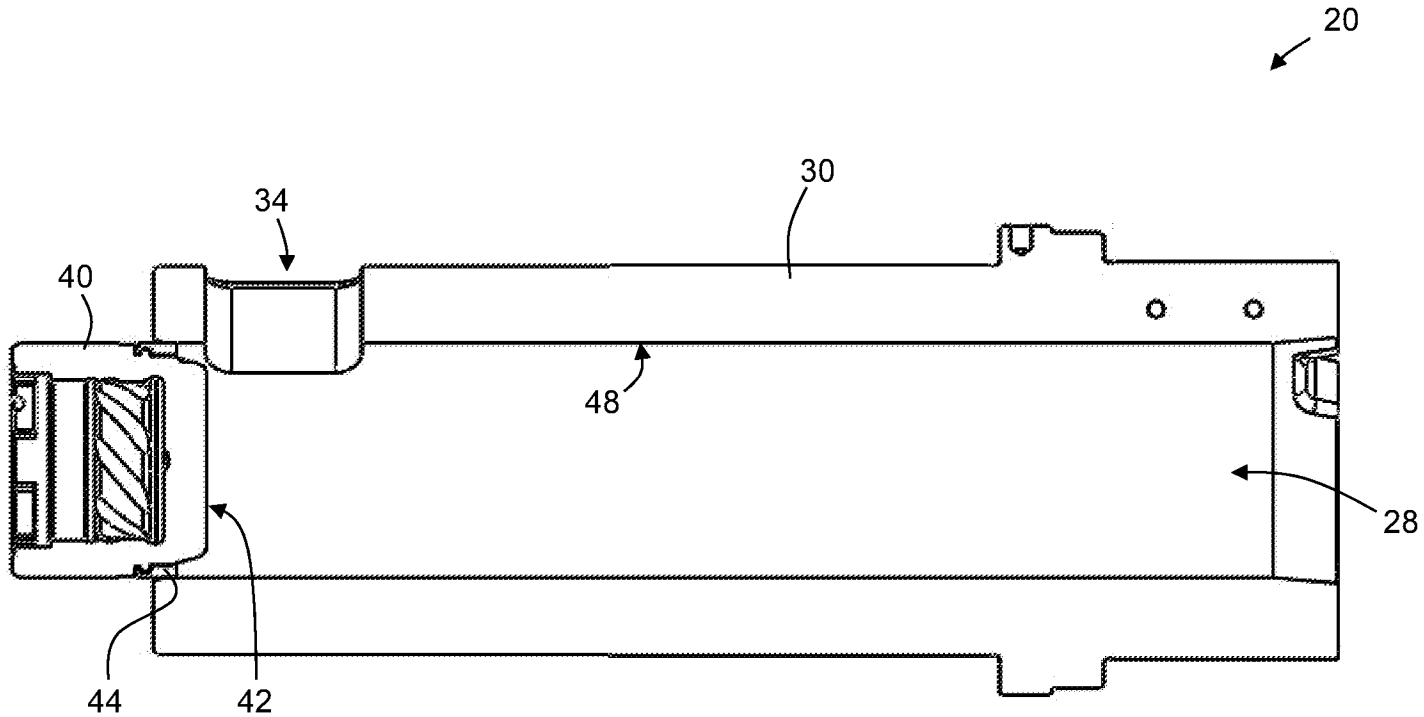
Figure 1 (PRIOR ART)
FIG. 1 is a sectional side view of a portion of a prior art die casting apparatus, comprising a prior art shot sleeve and a piston tip of a piston.

The foregoing summary, as well as the following detailed description of embodiments will be better understood when read in conjunction with the appended drawings. As used herein, an element or feature introduced in the singular and preceded by the word "a" or "an" should be understood as not necessarily excluding the plural of the elements or features. Further, references to "one example" or "one embodiment" are not intended to be interpreted as excluding the existence of additional examples or embodiments that also incorporate the described elements or features. Reference herein to "example" means that one or more feature, structure, element, component, characteristic and/or operational step described in connection with the example is included in at least one embodiment and/or implementation of the subject matter according to the subject disclosure. Thus, the phrases "an example," "another example," and similar language throughout the subject disclosure may, but do not necessarily, refer to the same example. Further, the subject matter characterizing any one example may, but does not necessarily, include the subject matter characterizing any other example.

Unless explicitly stated to the contrary, examples or embodiments "comprising" or "having" or "including" an element or feature or a plurality of elements or features having a particular property may include additional elements or features not having that property. Also, it will be appreciated that the terms "comprises", "has", "includes" means "including but not limited to" and the terms "comprising", "having" and "including" have equivalent meanings.

As used herein, the term "and/or" can include any and all combinations of one or more of the associated listed elements or features.

It will be understood that when an element or feature is referred to as being "on", "attached" to, "affixed" to, "connected" to, "coupled" with, "contacting", etc. another element or feature, that element or feature can be directly on, attached to, connected to, coupled with or contacting the other element or feature or intervening elements may also be present. In contrast, when an element or feature is referred to as being, for example, "directly on", "directly attached" to, "directly affixed" to, "directly connected" to, "directly coupled" with or "directly contacting" another element of feature, there are no intervening elements or features present.

It will be understood that spatially relative terms, such as "under", "below", "lower", "over", "above", "upper", "front", "back" and the like, may be used herein for ease of description to describe the relationship of an element or feature to another element or feature as illustrated in the figures. The spatially relative terms can however, encompass different orientations in use or operation in addition to the orientation depicted in the figures.

Reference herein to "configured" denotes an actual state of configuration that fundamentally ties the element or feature to the physical characteristics of the element or feature preceding the phrase "configured to."

Unless otherwise indicated, the terms "first," "second," etc. are used herein merely as labels, and are not intended to impose ordinal, positional, or hierarchical requirements on the items to which these terms refer. Moreover, reference to a "second" item does not require or preclude the existence of a lower-numbered item (e.g., a "first" item) and/or a higher-numbered item (e.g., a "third" item).

As used herein, the terms "approximately" and "about" represent an amount close to the stated amount that still performs the desired function or achieves the desired result. For example, the terms "approximately" and "about" may refer to an amount that is within engineering tolerances that would be readily appreciated by a person skilled in the art.

Figure 2:
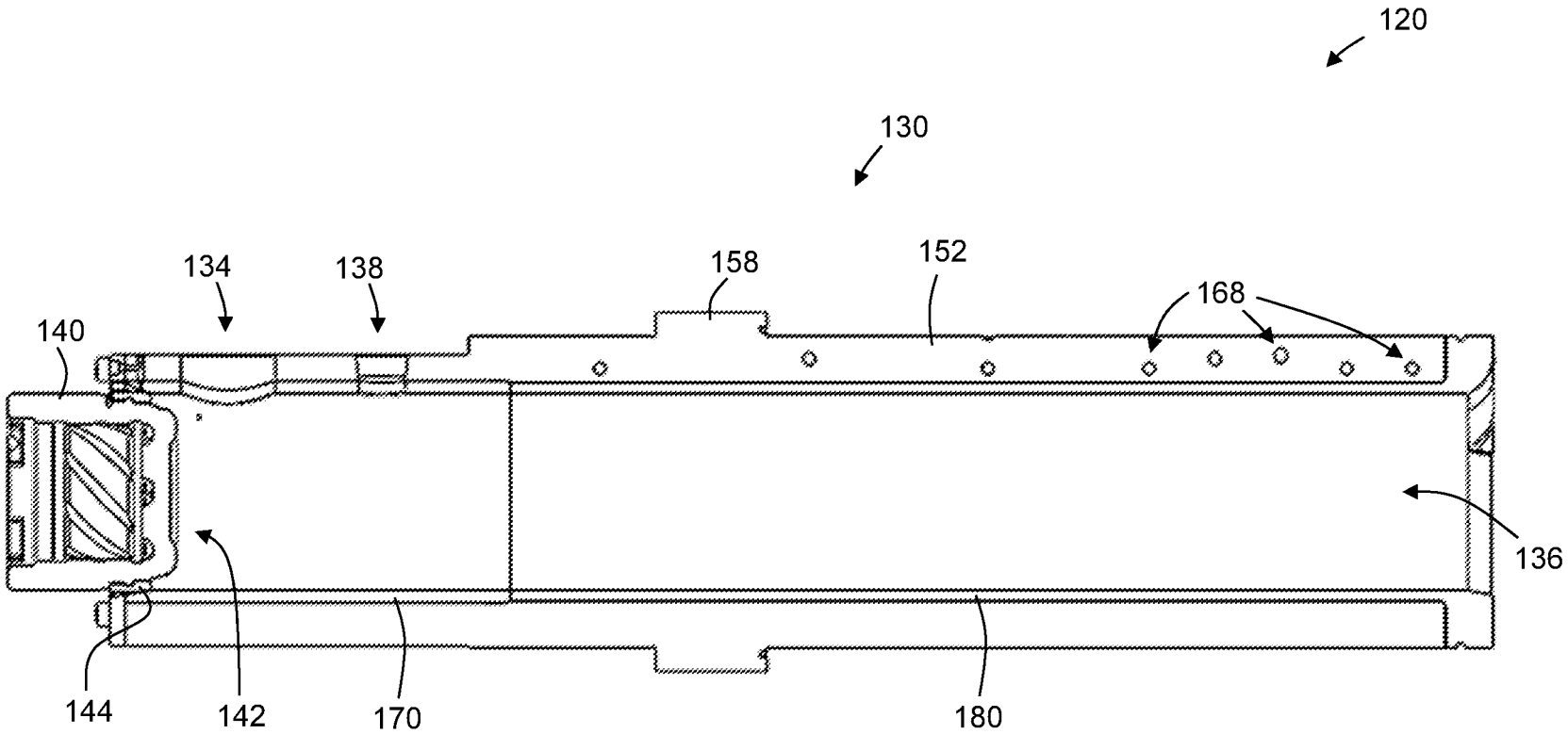
FIG. 2 is a sectional side view of a portion of a die casting apparatus, comprising a shot sleeve and a piston tip of a piston.
Figure 3:
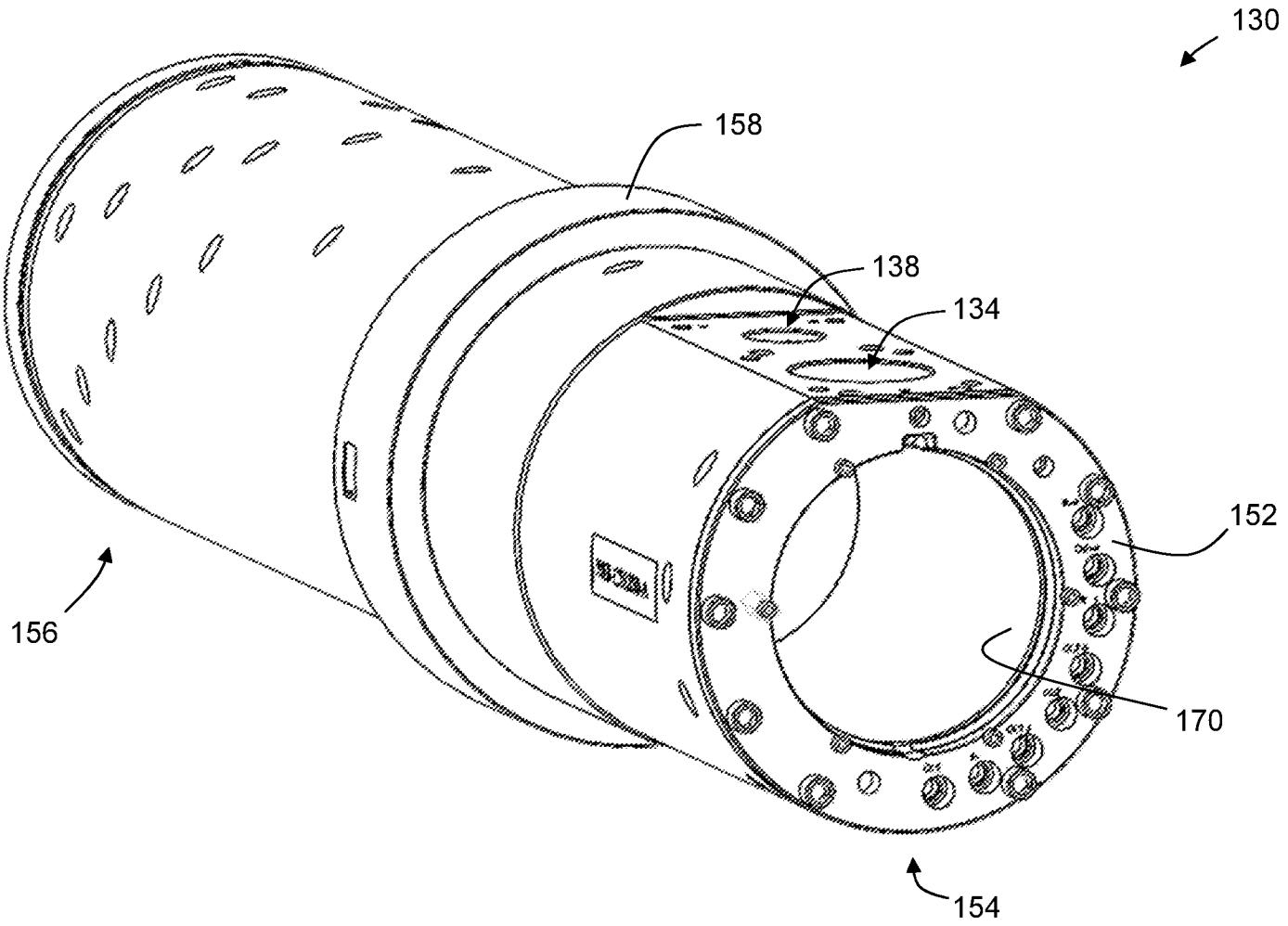
FIG. 3 is a perspective view of the shot sleeve of FIG. 2.
Figure 4:
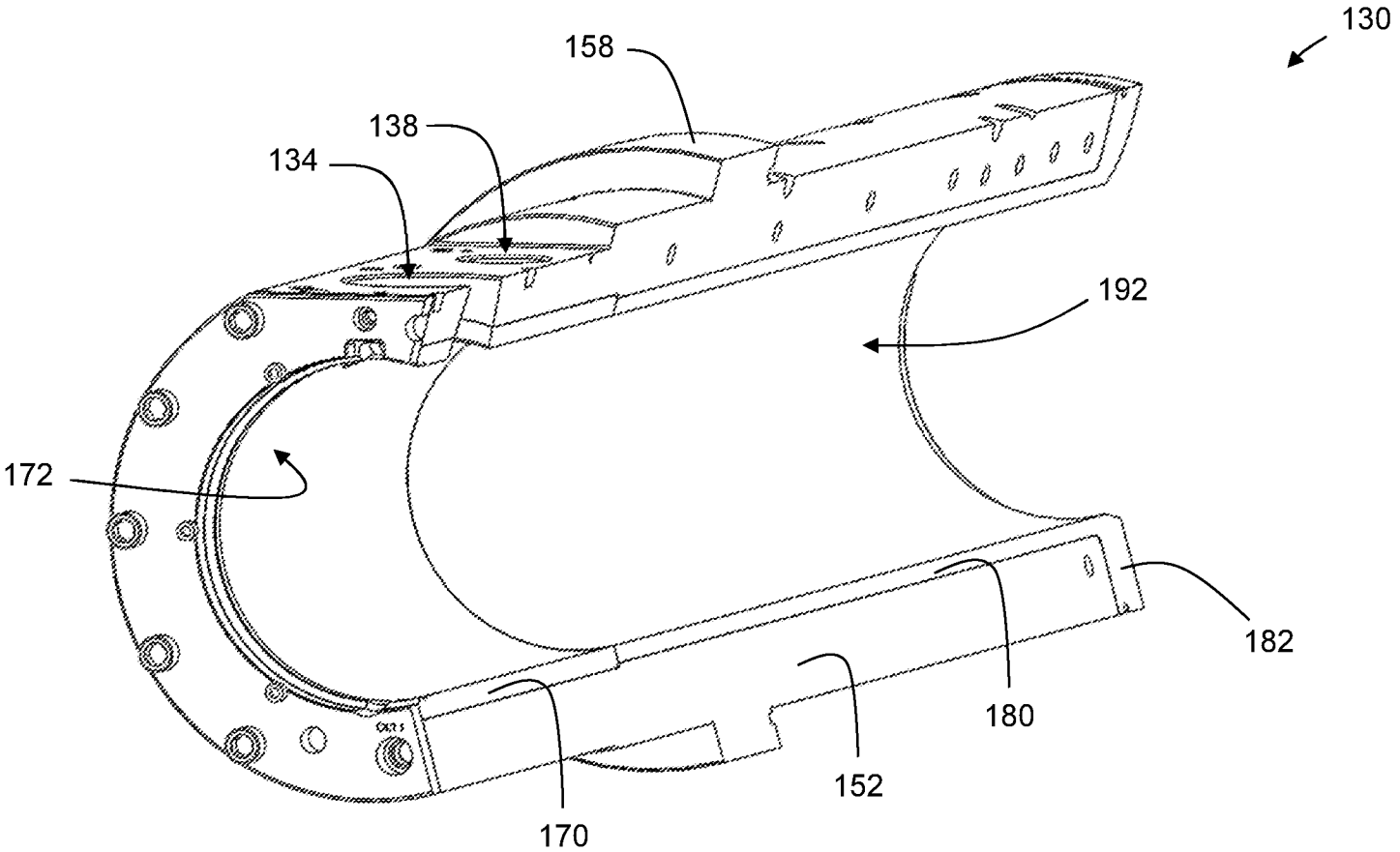
FIG. 4 is a sectional perspective view of the shot sleeve of FIG. 2.
Figure 5:
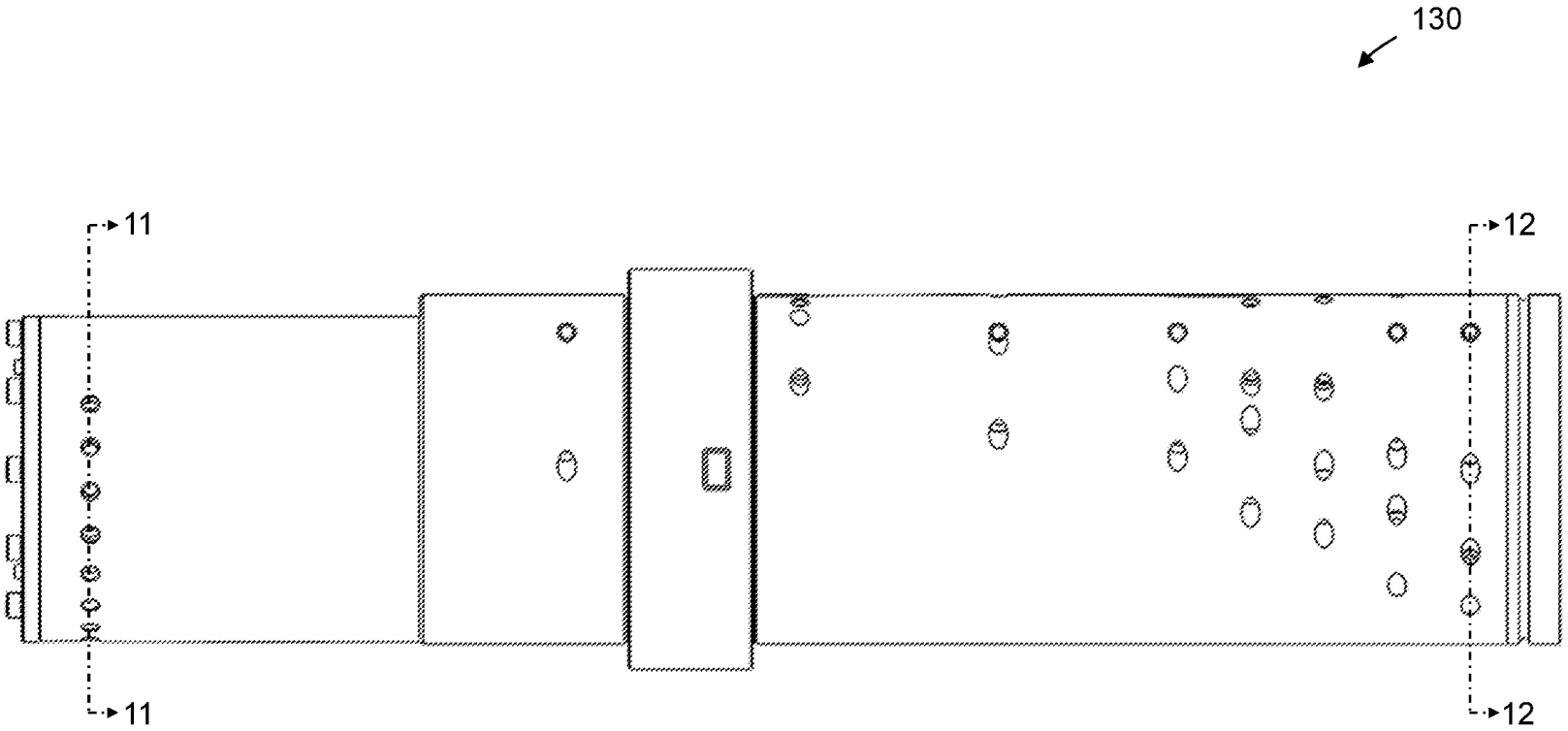
FIG. 5 is a side view of the shot sleeve of FIG. 2.
Figure 6:
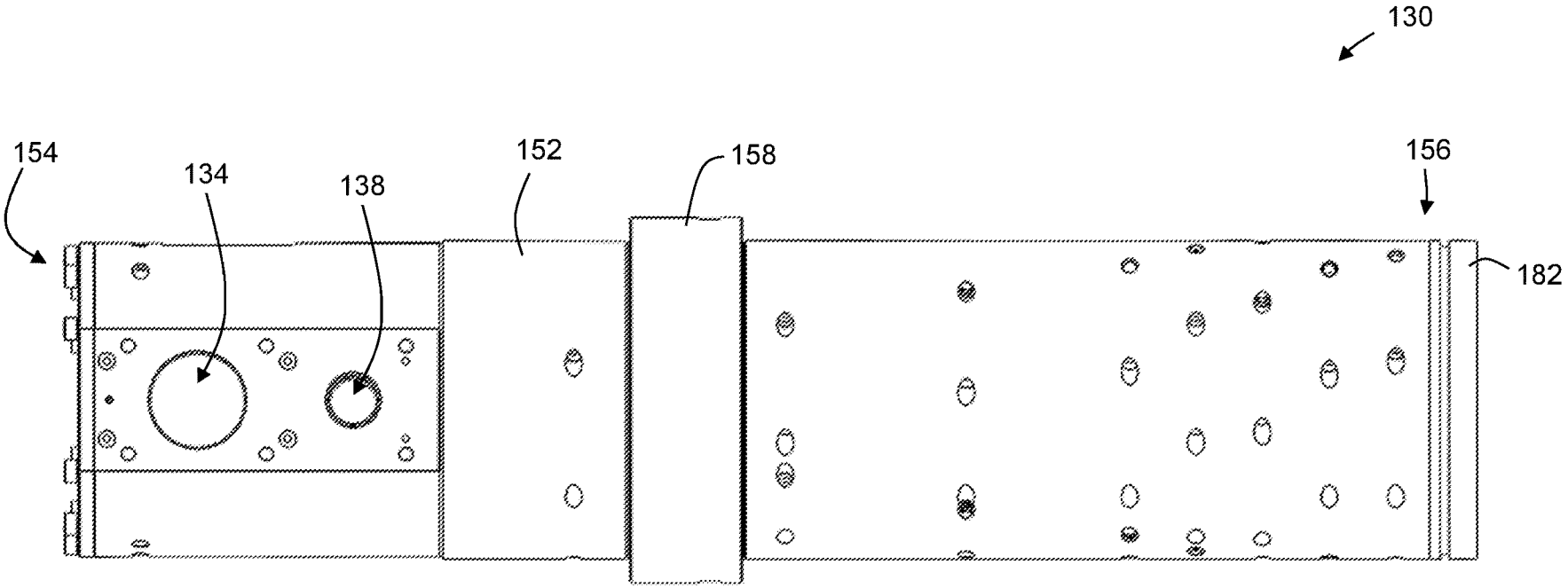
FIG. 6 is a top view of the shot sleeve of FIG. 2.
Figure 8:
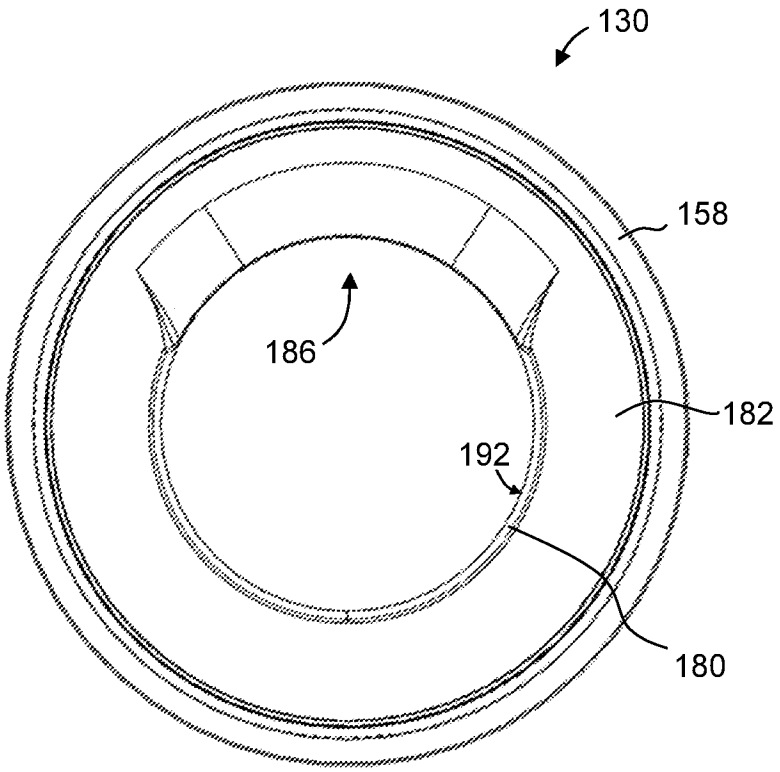
FIG. 8 is a die end view of the shot sleeve of FIG. 2.
Figure 7:
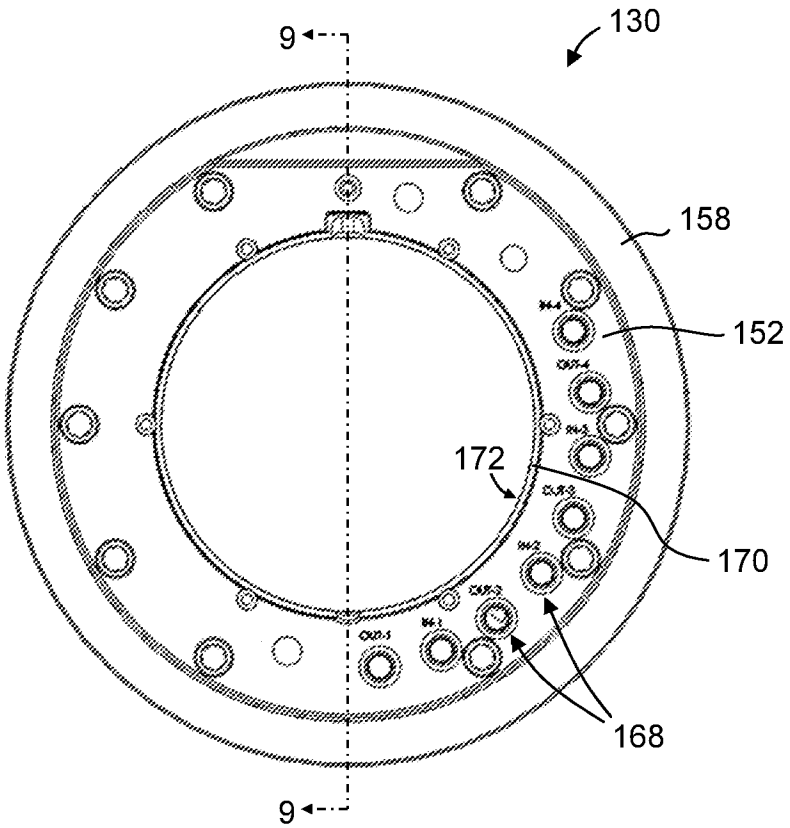
FIG. 7 is a pour end view of the shot sleeve of FIG. 2.
Figure 9:
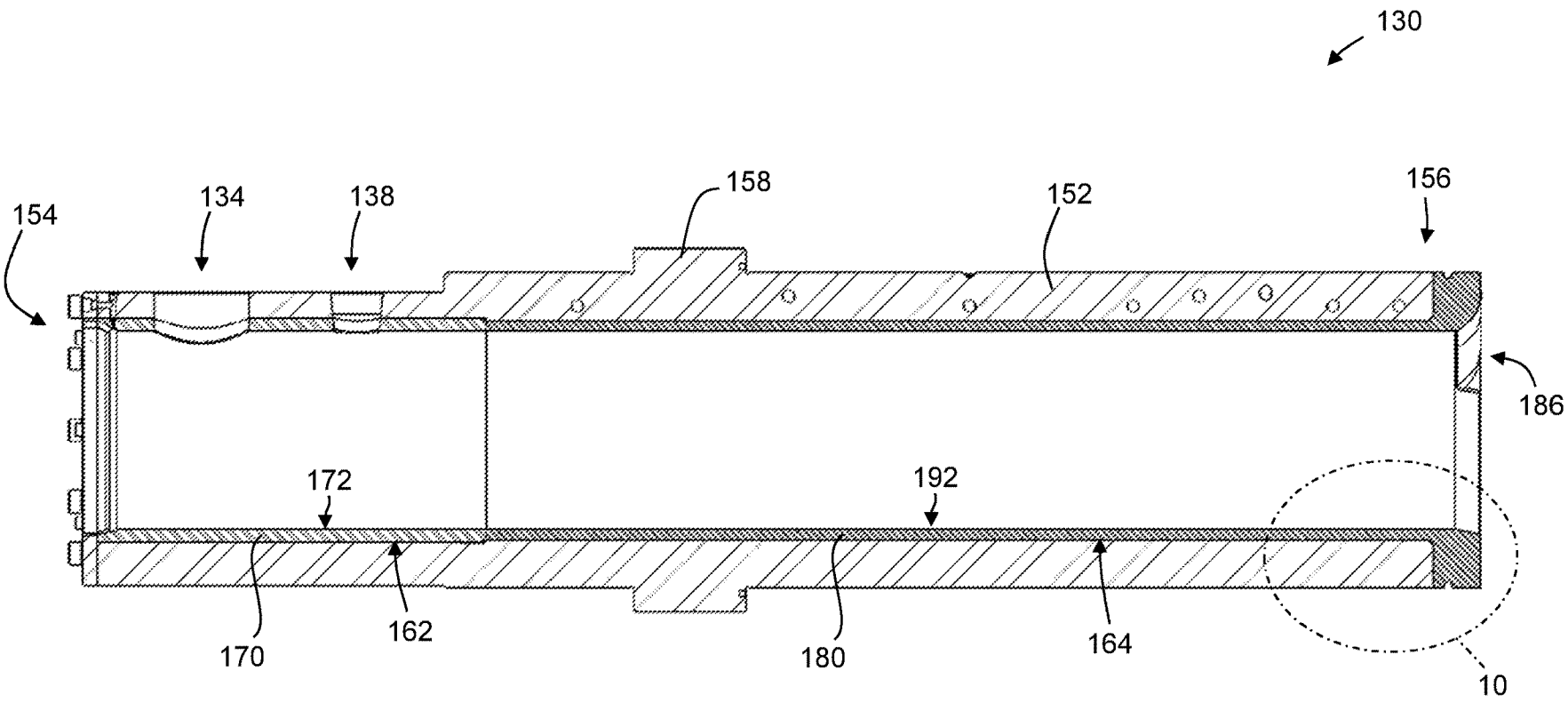
FIG. 9 is a sectional side view of the shot sleeve of FIG. 7, taken along the indicated section line.
Figure 10:
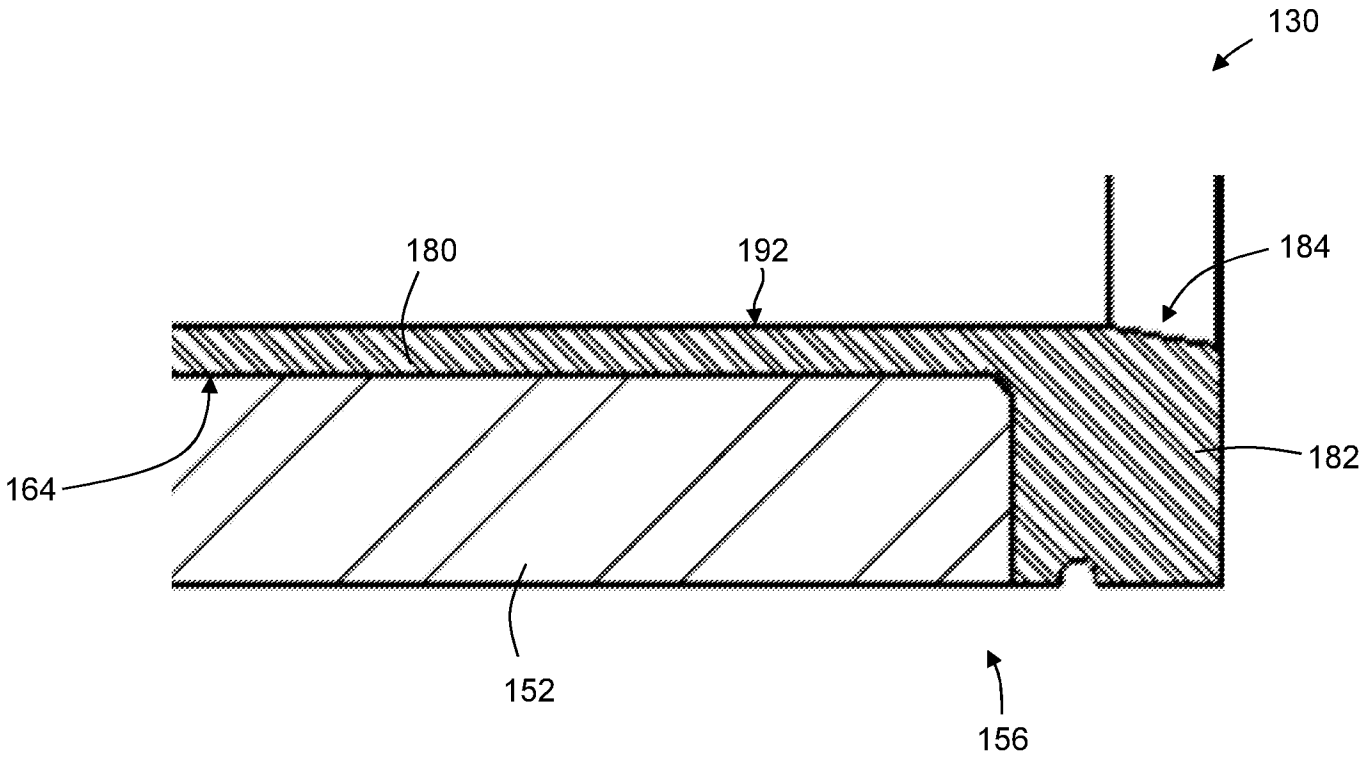
FIG. 10 is an enlarged fragmentary view of a portion of the shot sleeve of FIG. 9 identified by reference numeral 10.
Figure 12:
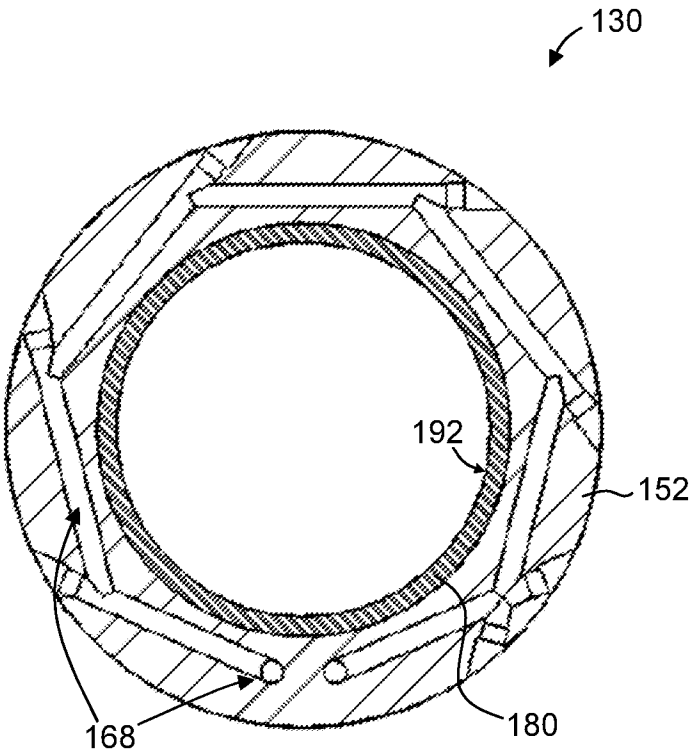
FIGS. 11 and 12 are sectional views of the shot sleeve of FIG. 5, taken along the indicated section lines.
Figure 11:
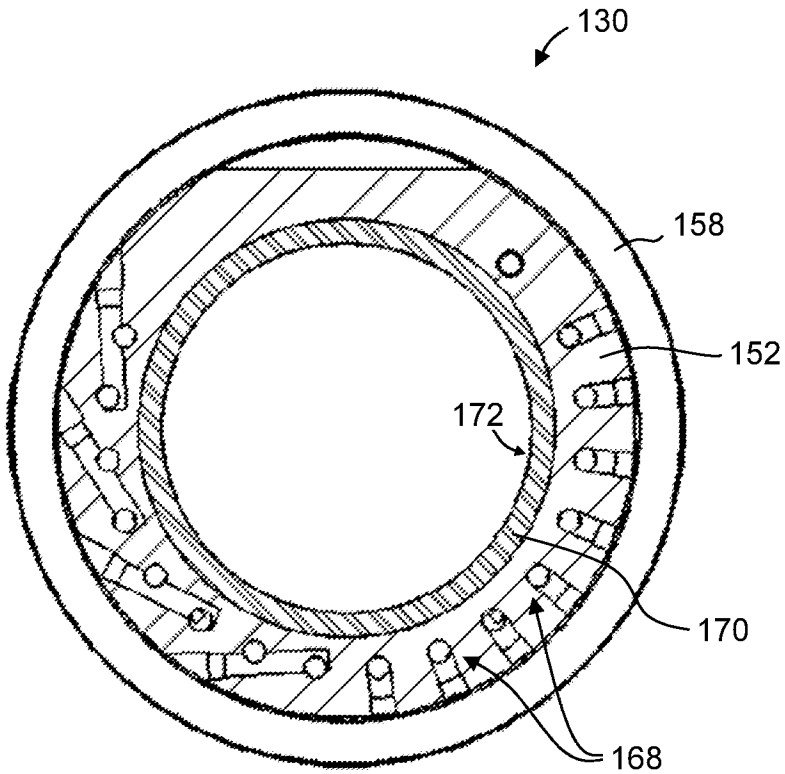

Turning now to FIG. 2, a portion of a vacuum-assisted die casting apparatus is shown and is generally indicated by reference numeral 120. Vacuum-assisted die casting apparatus 120 comprises a piston that is moveable within a piston bore defined within a shot sleeve 130 for pushing a volume of liquid metal (not shown) into a die casting mold cavity (not shown) to form a casting. The shot sleeve 130 comprises a rear port 134, through which the volume of liquid metal is introduced into the piston bore 136, and a forward port 138, through which vacuum is drawn from the piston bore 136. In the example shown, the piston is positioned at its starting position of the stroke, which is rearward of the rear port 134.

The piston comprises a piston tip 140 mounted on a forward end of a piston stem (not shown). The piston tip 140 has a front face 142 that is configured to contact the volume of liquid metal introduced into the piston bore 136 via rear port 134. The piston tip 140 has a wear ring 144 disposed on an outer surface thereof.

The shot sleeve 130 may be better seen in FIGS. 3 to 12. The shot sleeve 130 comprises an elongate shot sleeve body 152 fabricated of a material that has higher toughness and higher thermal conductivity than commonly used tool steels, and in this embodiment the body 152 is fabricated of AISI 4340 grade steel. For example, the toughness (at 44 HRC hardness) of AISI 4340 grade steel is about 42 J/m$^3$, while the toughness (at 44 HRC hardness) of AISI H13 grade steel, a commonly used tool steel, is about 24 J/m$^3$. As another example, the thermal conductivity of AISI 4340 grade steel is about 42 W/(m·K), while the thermal conductivity of AISI H13 grade steel is about 25 W/(m·K). Body 152 has a pour end 154 and a die end 156, and an outwardly extending circumferential rib 158 for enabling the shot sleeve 130 to be mechanically coupled to a die platen (not shown) or a machine platen (not shown) of the die casting apparatus 120. The body 152 has an axial bore extending therethrough, and in this embodiment the axial bore comprises a first axial bore 162 and a second axial bore 164. The first axial bore 162 extends partially into the length of the body 152 from the pour end 154, and the second axial bore 164 extends partially into the length of the body 152 from the die end 156. The first and second axial bores 162 and 164 are axially aligned, and in the embodiment shown the first axial bore 162 has a larger diameter than the second axial bore 164. The body 152 also has a plurality of internal conduits 168 surrounding the first and second axial bores 162 and 164, which are configured to convey cooling fluid from a cooling fluid source (not shown) for cooling the shot sleeve 130 during operation. The cooling fluid may be water, oil, air, and the like.

The shot sleeve 130 comprises a replaceable first sleeve insert 170 accommodated within the first axial bore 162 of the body 152. The first sleeve insert 170 is fabricated of a material that has higher hardness, higher high-temperature (namely, from about 625° C. to about 825° C.) yield strength and higher aluminum (Al) corrosion resistance than the shot sleeve body 152, and in this embodiment the first sleeve insert 170 is fabricated of hot worked DIN 1.2367 grade steel. As will be understood, DIN 1.2367 grade steel has higher hardness, higher high-temperature yield strength, higher hot wear resistance, and higher aluminum (Al) corrosion resistance than AISI 4340 grade steel, while AISI 4340 grade steel has higher toughness and higher thermal conductivity than DIN 1.2367 grade steel. The first sleeve insert 170 has a rear aperture and a forward aperture aligned with the rear port 134 and the forward port 138, respectively. The first sleeve insert 170 also has a nitride surface layer 172 that is formed during a nitriding treatment prior to insertion of the first sleeve insert 170 into the body 152.

The shot sleeve 130 also comprises a second sleeve insert 180 accommodated within the second axial bore 164 of the body 152. The second sleeve insert 180 is fabricated of a material that has higher ductility than the first sleeve insert 170, and higher hardness, higher high-temperature (namely, from about 625° C. to about 825° C.) yield strength and higher Al corrosion resistance than the body 152, and in this embodiment the second sleeve insert 180 is fabricated of DIN 1.2344 grade steel. As will be understood, DIN 1.2344 grade steel has higher hardness, higher high-temperature yield strength, higher hot wear resistance, and higher aluminum (Al) corrosion resistance than AISI 4340 grade steel, while AISI 4340 grade steel has higher toughness and higher thermal conductivity than DIN 1.2344 grade steel.

As will also be understood, DIN 1.2344 grade steel has higher ductility than DIN 1.2367, while DIN 1.2367 grade steel has a has higher hardness, higher high-temperature yield strength, higher hot wear resistance, and higher aluminum (Al) corrosion resistance than DIN 1.2344 grade steel. Ductility is typically measured by percent elongation and percent reduction in area of a tensile specimen during tensile testing. For example, the percent elongation and percent reduction in area (at 44 HRC hardness) of DIN 1.2344 grade steel are about 14% and about 40%, respectively, while the percent elongation and percent reduction in area (at 44 HRC hardness) of DIN 1.2367 grade steel are about 12% and about 39%, respectively.

In this embodiment, the second sleeve insert 180 comprises a flange 182 that is shaped to extend outwardly so as to cover the die end 156 of the body 152. The flange 182 has a frustoconical, beveled inner surface 184 that is inclined relative to the center axis of the body 152, and a gating channel 186 defined in an upper portion of the beveled inner surface 184. As will be understood, as the gating channel 186 is exposed to liquid metal during operation, the portion of the flange 182 between the gating channel 186 and the body 152 protects the body 152 from direct exposure to liquid metal.

The second sleeve insert 180 has a nitride surface layer 192 that is formed during a nitriding treatment prior to insertion of the second sleeve insert 180 into the body 152.

In operation, at the beginning of a stroke cycle, the piston is positioned at its starting position in the piston bore 136, and a volume of liquid metal is introduced into the piston bore 136 forward of the piston tip 140 via rear port 134. The piston is then moved forward through the piston bore 136 to push the volume of liquid metal into the mold cavity for forming a metal casting, and is then moved rearward to its starting position to complete the stroke cycle. During this movement, the wear ring 144 disposed on the piston tip 140 continuously contacts the surface of the piston bore 136, and provides a liquid metal seal for preventing liquid metal from passing between the piston tip 140 and the surface of the piston bore 136. The wear ring 144 also provides a vacuum seal for maintaining vacuum (that is, a low pressure) within the forward volume of the piston bore 136. The cycle is repeated, as desired, to produce multiple metal castings.

As will be appreciated, the high high-temperature yield strength of the first sleeve insert 170 and second sleeve insert 180 advantageously increases the resistance of the shot sleeve 130 to "heat checking", namely the formation and propagation of cracks on the surface of the piston bore due to the temperature changes associated with each stroke cycle. As a result, the likelihood of failure of the shot sleeve 130 due to heat checking is reduced or eliminated, as compared to conventional shot sleeves fabricated of other steels.

As will be appreciated, the higher ductility of the second sleeve insert 180 compared to the first sleeve insert 170 further increases the resistance of the shot sleeve 130 to "heat checking" in the portion of the piston bore 136 defined by the second sleeve insert 180. As will be understood, among materials having high high-temperature yield strength, higher ductility advantageously further reduces the tendency for crack formation and crack propagation to occur.

As will be appreciated, the higher Al corrosion resistance of the first sleeve insert 170 compared to the second sleeve insert 180 provides resistance to Al corrosion-induced wear, sometimes referred to as "washout", in the portion of the piston bore 136 where wear resistance to Al corrosion is more needed, namely under the rear port 134 where the introduced volume of liquid metal directly impacts the surface of the piston bore 136 with force. As will be understood, the higher Al corrosion resistance of DIN 1.2367 grade steel results from a combination of compositional differences and a higher annealing temperature of DIN 1.2367 grade steel as compared to DIN 1.2344 grade steel. As will also be appreciated, resistance to washout is less needed in portions of the piston bore 136 forward of the rear port 134.

As will be appreciated, the flange 182, which is shaped to cover the body 152 at the die end 156, advantageously prevents exposure of the body 152 to liquid metal, and thereby increases the resistance of the shot sleeve 130 to "heat checking" as compared to conventional shot sleeves having a body not covered by a flange of ductile material at the die end, and/or to conventional shot sleeves having gating channels formed directly in the shot sleeve body at the die end. Additionally, as the flange 182, which forms part of the second sleeve insert 180, is fabricated of a material that has higher Al corrosion resistance than the body 152, the flange 182 advantageously provides some resistance to Al corrosion-induced wear at the die end 156 of the body 152.

As will be appreciated, the high thermal conductivity of the body 152 advantageously increases thermal dissipation within the shot sleeve 130. As a result, the shot sleeve 130 has a more uniform temperature distribution and experiences less shape distortion due to thermal expansion, as compared to conventional shot sleeves fabricated of commonly used tool steels. Additionally, and as will be appreciated, the high toughness of the body 152 advantageously increases the resistance of the shot sleeve 130 to thermal shock cracking. As a result, the likelihood of failure of the shot sleeve 130 due to thermal shock cracking is reduced or eliminated, as compared to conventional shot sleeves fabricated of commonly used tool steels.

These features advantageously enable the shot sleeve 130 to be more durable and to have a longer service life than conventional shot sleeves.

As will be appreciated, the lower cost of DIN 1.2344 grade steel as compared to DIN 1.2367 grade steel advantageously reduces the cost of fabrication of the shot sleeve 130, as compared to conventional shot sleeves lined with DIN 1.2367 grade steel along the full length of the piston bore.

As will be appreciated, the beveled inner surface 184 of the shot sleeve 130 advantageously enables the metal casting to be more easily removed from the mold cavity. The beveled inner surface 184 of the shot sleeve 130 also advantageously facilitates rearward movement of the piston through the piston bore 136.

Other configurations are possible. For example, although in the embodiment described above, the second sleeve insert 180 has an outwardly extending flange 182 having a gating channel 186 defined therein, in other embodiments, the flange may alternatively not have a gating channel defined therein. In one such embodiment, for example, the shot sleeve may be used with a bushing disposed between the shot sleeve and the die platen or machine platen, and with the bushing having a channel such as a sprue channel) formed therein.

Although in the embodiment described above, the second sleeve insert 180 has an outwardly extending flange 182, in other embodiments, the second sleeve insert may alternatively have no outwardly extending flange, and the die end of the body may alternatively not be covered by the material of the second sleeve insert.

The materials are not limited to those of the embodiment described above, and in other embodiments, one or more of the body, the first sleeve insert and the second sleeve insert may alternatively be fabricated of another grade of steel, or of another metal alloy or other material. For example, the second sleeve insert may alternatively be fabricated of AISI H13 grade steel. In still other embodiments, one or both of the first sleeve insert and the second sleeve insert may alternatively be fabricated of another material having at least one of: a higher hardness than the body; a higher high-temperature yield strength than the body; and a higher aluminum corrosion resistance than the body, and where the material of which the second sleeve insert is fabricated has higher ductility than the material of which the first sleeve insert is fabricated.

Although embodiments have been described above with reference to the accompanying drawings, those of skill in the art will appreciate that variations and modifications may be made without departing from the scope thereof as defined by the appended claims.

What is claimed is:

1. A shot sleeve for a die casting apparatus, the shot sleeve having a piston bore, the shot sleeve comprising:

an elongate body fabricated of a first material, the body having an axial bore extending therethrough;

a first sleeve insert fabricated of a second material, the first sleeve insert being accommodated in the axial bore and defining a first surface of the piston bore; and a second sleeve insert fabricated of a third material, the second sleeve insert being accommodated in the axial bore and defining a second surface of the piston bore, the third material having a higher ductility than the second material, the first sleeve insert and the second sleeve insert having the same inside diameter, wherein the second sleeve insert comprises an outwardly extending flange having a gating channel formed therein, the gating channel extending outwardly from an opening of the piston bore, the outwardly extending flange being integral with the second sleeve insert.

2. The shot sleeve of claim 1, wherein the body is fabricated of AISI 4340 grade steel.

3. The shot sleeve of claim 1, wherein the second material has at least one of:

higher hardness than the first material;

higher high-temperature yield strength than the first material; and higher aluminum corrosion resistance than the first material.

4. The shot sleeve of claim 1, wherein the first sleeve insert is fabricated of hot worked DIN 1.2367 grade steel.

5. The shot sleeve of claim 1, wherein the third material has at least one of:

higher hardness than the first material;

higher high-temperature yield strength than the first material; and higher aluminum corrosion resistance than the first material.

6. The shot sleeve of claim 1, wherein the second sleeve insert is fabricated of hot worked DIN 1.2344 grade steel or AISI H13 grade steel.

7. The shot sleeve of claim 1, wherein the body comprises a port through which a volume of liquid metal is introduced into the piston bore, the first sleeve insert having an aperture aligned with the port.

8. The shot sleeve of claim 1, wherein the elongate body has a first end and a second end, and the axial bore extends between the first end and the second end.

9. The shot sleeve of claim 8, wherein the first sleeve insert is accommodated in the axial bore adjacent the first end.

10. The shot sleeve of claim 8, wherein the second sleeve insert is accommodated in the axial bore adjacent the second end.

11. The shot sleeve of claim 1, wherein the flange covers the body at the second end.

12. The shot sleeve of claim 1, wherein the gating channel is defined in an upper portion of the flange.

13. A die casting apparatus comprising the shot sleeve of claim 1.

14. A shot sleeve for a die casting apparatus, the shot sleeve having a piston bore, the shot sleeve comprising:

an elongate body fabricated of a first material, the body having an axial bore extending therethrough;

a first sleeve insert fabricated of a second material, the first sleeve insert being accommodated in the axial bore and defining a first surface of the piston bore; and a second sleeve insert fabricated of a third material, the second sleeve insert being accommodated in the axial bore and defining a second surface of the piston bore, the third material having a higher ductility than the second material, wherein the second sleeve insert comprises an outwardly extending flange having a frustoconical beveled inner surface, and a gating channel formed in a portion of the frustoconical beveled inner surface.

15. The shot sleeve of claim 14, wherein the flange covers the body at the second end.

16. The shot sleeve of claim 14, wherein the body is fabricated of AISI 4340 grade steel.

17. The shot sleeve of claim 14, wherein the second material has at least one of:

higher hardness than the first material;

higher high-temperature yield strength than the first material; and higher aluminum corrosion resistance than the first material.

18. The shot sleeve of claim 14, wherein the first sleeve insert is fabricated of hot worked DIN 1.2367 grade steel.

19. The shot sleeve of claim 14, wherein the third material has at least one of:

higher hardness than the first material;

higher high-temperature yield strength than the first material; and higher aluminum corrosion resistance than the first material.

20. A die casting apparatus comprising the shot sleeve of claim 14.

* * * * *